United States Patent [19]

Fitzsimmons et al.

[11] Patent Number: 5,027,124

[45] Date of Patent: Jun. 25, 1991

[54] SYSTEM FOR MAINTAINING POLARIZATION AND SIGNAL-TO-NOISE LEVELS IN RECEIVED FREQUENCY REUSE COMMUNICATIONS

[75] Inventors: George W. Fitzsimmons; Bernard J. Lamberty, both of Kent, Wash.

[73] Assignee: The Boeing Company, Seattle, Wash.

[21] Appl. No.: 325,450

[22] Filed: Mar. 17, 1989

[51] Int. Cl.[5] ..... H01Q 21/06; H01Q 21/24

[52] U.S. Cl. ..... 342/362

[58] Field of Search ..... 342/361, 362, 372, 373

[56] References Cited

U.S. PATENT DOCUMENTS

| | | | |
|---|---|---|---|
| 3,883,872 | 5/1975 | Fletcher et al. . | |
| 3,921,169 | 11/1975 | Lazarchik et al. . | |
| 4,087,818 | 5/1978 | Kreutel, Jr. . | |
| 4,268,829 | 5/1981 | Baurle et al. . | |
| 4,315,262 | 2/1982 | Acampora et al. . | |
| 4,492,962 | 1/1985 | Hansen | 342/373 |
| 4,532,518 | 7/1985 | Gaglione et al. . | |

*Primary Examiner*—Theodore M. Blum

*Attorney, Agent, or Firm*—Christensen, O'Connor, Johnson & Kindness

[57] ABSTRACT

In a preferred embodiment, the disclosed system is part of a communication system (10) formed by a satellite (12) and aircraft (14). The system includes a controllable antenna network (16) and polarization tracking network (18). The controllable antenna network includes an array (28) of orthogonal antenna pairs (34) whose beams are steerable by phase shifters (46) to correct for changes in the aircraft's attitude. Similarly, amplifier circuits (44) compensate for changes that would otherwise occur in the signal-to-noise ratio of the antenna's output. The polarization tracking network includes a forward section (62), defined by quadrature hybrids (66) and (70) and an adjustable phase shifter (68), and a feedback section (64) that monitors each polarity for the presence of a single select channel. The phase shifter responds to the comparison made by a phase detector (86) in the feedback section to maintain the desired polarization of all channels.

25 Claims, 4 Drawing Sheets

SYSTEM FOR MAINTAINING POLARIZATION AND SIGNAL-TO-NOISE LEVELS IN RECEIVED FREQUENCY REUSE COMMUNICATIONS

FIELD OF THE INVENTION

This invention relates generally to the processing of signals in communication systems and, more particularly, to the maintenance of desired polarizations and signal-to-noise levels in frequency reuse communications received at a site that is relatively movable with respect to a source of the communications.

BACKGROUND OF THE INVENTION

In the context of commercial aviation, aircraft passengers are often provided with information having instructional and entertainment value. In conventional systems, a relatively limited volume of such information is stored onboard the aircraft and made available to the passengers when the aircraft is in flight. For example, a single in-flight video presentation and several audio presentations are typically stored on tape. This software is loaded into a playback system by an airline employee and playback is initiated at the beginning of the flight. The information is then accessed by the passengers, in part, via headsets located at each seat. As suggested above, this approach offers the passenger an extremely limited program selection. Further, the information is only periodically updated and, when it is, the participation of a software vendor service and aircraft personnel is required.

As an alternative to the use of stored program information, we propose the continuous transmission of information to the aircraft by direct-broadcast satellite. This approach has the advantages of offering a much wider program selection to the passenger on a more frequently updated basis. Such programming would also be more appealing to passengers because it offers continuity with the radio and television fare that passengers are familiar with, and have available, every day. In addition, by eliminating the need for specially developed programs administered by airline personnel and their contracted vendors, it is anticipated that the cost to both airlines and passengers would decrease.

Our proposal does, however, present several problems. First, because the proposed source of transmissions is a geostationary satellite, an antenna provided on the aircraft must be capable of maintaining an antenna beam directed to the satellite as the aircraft traverses its flight path. Although conventional parabolic reflector antennas might be able to satisfy this requirement, their use would impose a heavy drag penalty on the aircraft. As a related problem, the signal-to-noise ratio produced by the antenna may vary undesirably with changes in the aircraft's position.

A second difficulty presented by our proposal relates to the form of transmissions contemplated. Broadly speaking, in communication systems relying upon the transmission of electromagnetic radiation through an unconfined medium, such as the atmosphere, interference between multiple sources and receivers operating over the same portion of the frequency spectrum is a problem. To limit such interference, the government regulates both the frequency and power of such transmissions. With increasing user demand for the available portions of the finite frequency spectrum, efforts have been made to convey greater information over smaller frequency ranges. This is particularly true in the context of satellite communications, where the effective reception area is so great as to effectively preempt all but one operator from using a given portion of the frequency spectrum.

One method developed to use the available portions of the spectrum more efficiently is commonly referred to as "frequency reuse communication". This approach basically involves the use of the same frequencies by two signals conveying independent information and is typically accomplished by transmitting the two signals via electromagnetic fields that are orthogonally polarized. For example, the electric field transmitted by one signal may be aligned perpendicular to the earth's surface (i.e., vertically polarized), while the electric field transmitted by the other signal runs parallel to the earth's surface (i.e., horizontally polarized). Even though the two signals have the same frequency, the information conveyed by each can be distinguished on the basis of its polarity, thus effectively doubling the information-carrying capacity of the spectrum.

As will be appreciated, extraction of information from signals conveyed in this manner becomes significantly more difficult if energy is transferred from one polarization to another. Such "cross-polarizations" may be introduced by irregularities in the transmitter, transmitting medium, or receiver of the system. These irregularities may include, for example, the nonorthogonal propagation of polarized signals at the transmitter, the disruptive presence of elements such as rain in the transmitting medium, and the nonorthogonal alignment of antenna elements at the receiver, each of which will result in the transfer of energy between polarizations. As a result, the signals are no longer easily distinguished by polarity, resulting in transmission interference and less than optimal power transfer.

As will be appreciated, when the efficiency of direct-broadcast satellite is to be increased by frequency reuse techniques, motion of the aircraft may also contribute to cross-polarization of the orthogonal signals. Specifically, although the proposed system will provide a steered antenna beam, aircraft motion may disrupt the effective orthogonality of the antenna elements, resulting in the transfer of energy between the two orthogonal signals. Thus, it would be desirable to provide a system for maintaining the desired polarity of the frequency reuse communications transmitted between a source and receiver undergoing relative motion.

In that regard, various attempts have been made to reduce the effects of cross-polarization occurring in other applications. For example, prior art systems have been developed in which pilot signals are used to detect the cross-polarization. A cancellative form of correction is then employed in which a portion of one of the polarized signals is processed and used to cancel the portion of that signal appearing on the other polarization. Prior art approaches have, however, had the disadvantages of being relatively complicated, requiring cooperative signals to be supplied with transmissions, and possibly requiring separate correction for each of the channels being communicated. As a result, it would be desirable to provide a relatively simple system for simultaneously maintaining the proper polarization of a plurality of frequency reuse communication channels.

SUMMARY OF THE INVENTION

In accordance with this invention, a movable system for receiving frequency reuse communications from a referentially fixed source is disclosed. The system includes a controllable antenna for receiving frequency reuse communications from the source and an adaptive polarization tracking network for maintaining the desired polarization of the communications received by the antenna.

Reviewing these elements in greater detail, the controllable antenna includes a pair of orthogonal antenna elements. A pair of phase shifters, which respond to information concerning the relative position of the system and source, effectively steer the antenna beam to the source as the system moves. A pair of low-noise amplifiers, in cooperation with two quadrature hybrids, minimizes the signal-to-noise ratio change as this steering process occurs.

The adaptive polarization tracking network, in turn, further includes a forward section and a feedback section. The forward section includes a pair of quadrature hybrids coupled by an adjustable phase shifter, which is responsive to the feedback section. The feedback section includes a pair of filters that pass a select midchannel, which will be present on the two signals when cross-polarization occurs. These signals are then compared at a phase detector, which provides the necessary feedback to the adjustable phase shifter. The phase shifter adjusts the relative phase of the signals in one direction if the two signals are in phase and in the other direction if they are out of phase, driving one of the signals to a null.

In accordance with another aspect of this invention, an adaptive polarization tracking network is provided for maintaining a desired polarity between a first polarized signal defining a first set of information channels and a second polarized signal defining a second set of information channels. The network includes a monitor device for monitoring the first and second polarized signals and producing an output indicative of the presence of a select information channel on each. In addition, a null circuit responds to the output of the monitor device to null the selected information channel on one of the first and second polarized signals to maintain the desired polarity therebetween.

In accordance with yet another aspect of this invention, a steerable antenna system is disclosed. The system includes a steerable antenna for receiving electromagnetic radiation and producing a signal in response thereto. The system also includes a circuit that receives the antenna signal and maintains a substantially uniform signal-to-noise ratio as the antenna is steered.

BRIEF DESCRIPTION OF THE DRAWINGS

The invention will presently be described in greater detail, by way of example, with reference to the accompanying drawings, wherein.

DETAILED DESCRIPTION OF A PREFERRED EMBODIMENT OF THE INVENTION

Figure 1:
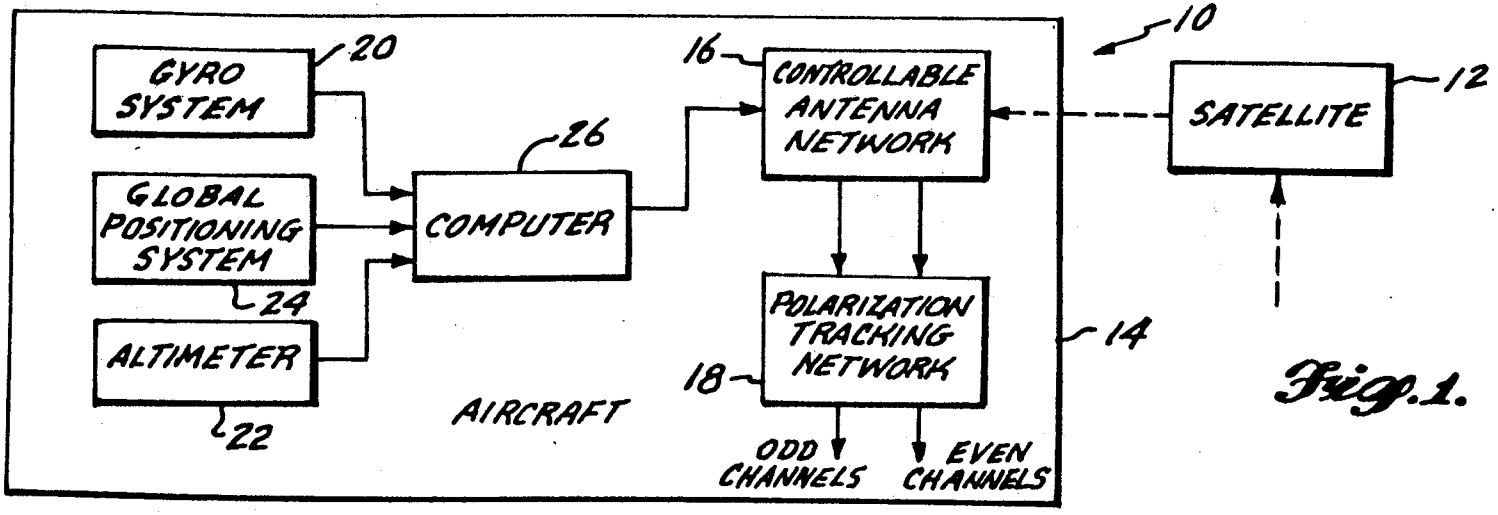
FIG. 1 illustrates a block diagram of one application for a polarization and signal-to-noise level maintenance system constructed in accordance with this invention.

Referring now to FIG. 1, one application for a system constructed in accordance with this invention is illustrated. More particularly, the system is part of a communication system 10 including a satellite 12 and aircraft 14. In the proposed arrangement, the satellite 12 provides information in the form of video and audio programming to aircraft 14 via frequency reuse communications. Compensation for the changing position and orientation of aircraft 14 with respect to satellite 12 is accomplished by two components of the system.

Specifically, a controllable antenna network 16 is designed to ensure that a receiving antenna beam remains directed to the satellite 12, while maximizing the signal-to-noise ratio, regardless of the maneuvers performed by aircraft 14. Similarly, a polarization tracking network 18 is included to maintain a desired polarity between the frequency reuse communications received by network 16 as the relative orientation between aircraft 14 and satellite 12 changes.

Figure 2:
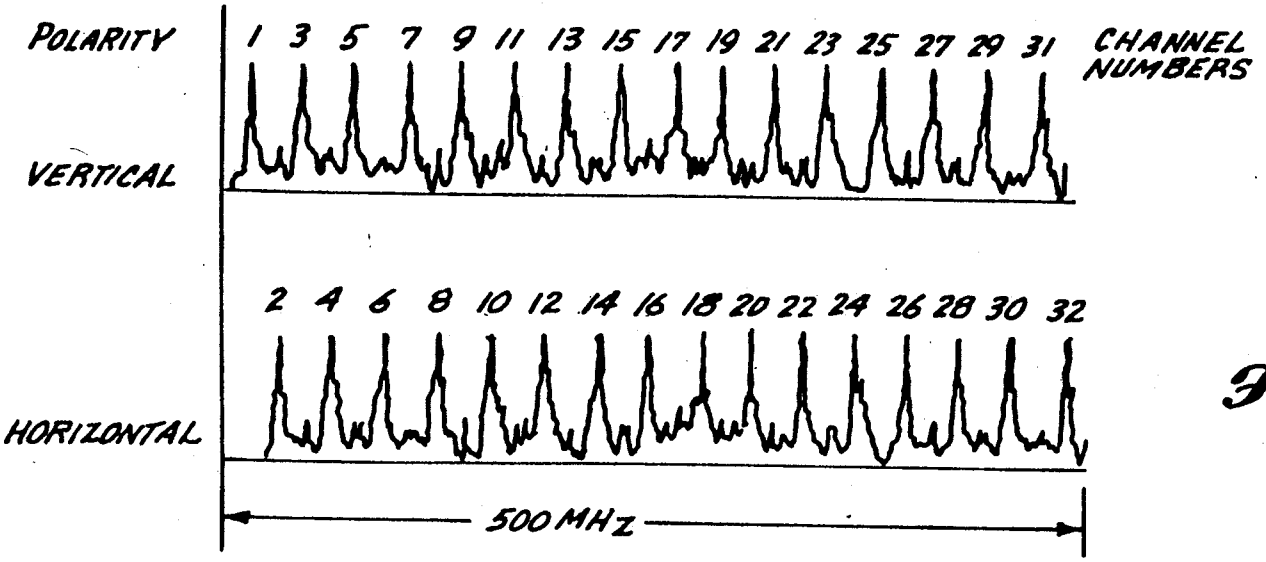
FIG. 2 is a graph illustrating the relative distribution of channels over the portion of the frequency spectrum processed by the polarization and signal-to-noise level maintenance system.

In the currently proposed arrangement, satellite 12 is of the direct broadcast type, employing frequency reuse communications in the ku band of the frequency spectrum. This band is centered near 12 GHz and has a bandwidth of 500 MHz. The system is expected to be capable of transmitting up to 32 stereo television channels, with 16 even channels being transmitted on one (e.g., horizontal) polarity and 16 odd channels being transmitted on the other (e.g., vertical) polarity. The center of each channel is located at a frequency midway between the frequencies of the two nearest, orthogonally polarized channels. FIG. 2 illustrates the relative distribution of the even and odd channels within the ku band portion of the frequency spectrum.

In a conventional system, the ultimate source of the satellite communications is an earthbound transmission site (not shown). From this site, information to be conveyed to aircraft 14 is transmitted to the geostationary satellite 12 located approximately three earth diameters away. The satellite 12 is equipped to receive these transmissions and directly rebroadcast them across an area encompassing, for example, the continental United States. It is anticipated that signal power on the order of 100 to 200 watts per channel will eventually be available from such systems.

Addressing now details of the receiving aircraft 14, as will be appreciated, it can be one of any conventionally available aircraft 14. As depicted in the block diagram of FIG. 1, the aircraft 14 includes a number of subsystems designed to aid the controllable antenna network 16 in maintaining the desired antenna beam alignment with satellite 12. More particularly, a gyrosystem 20 produces continuous information concerning the yaw, pitch, and roll of aircraft 14. An altimeter 22 similarly produces continuous information concerning the altitude of aircraft 14. In addition, a global positioning system 24 maintains updated information regarding the longitude and latitude of aircraft 14. A computer 26 monitors information received from each of these sources to provide feedback to the controllable antenna network 16 as described in greater detail below.

Figure 3:
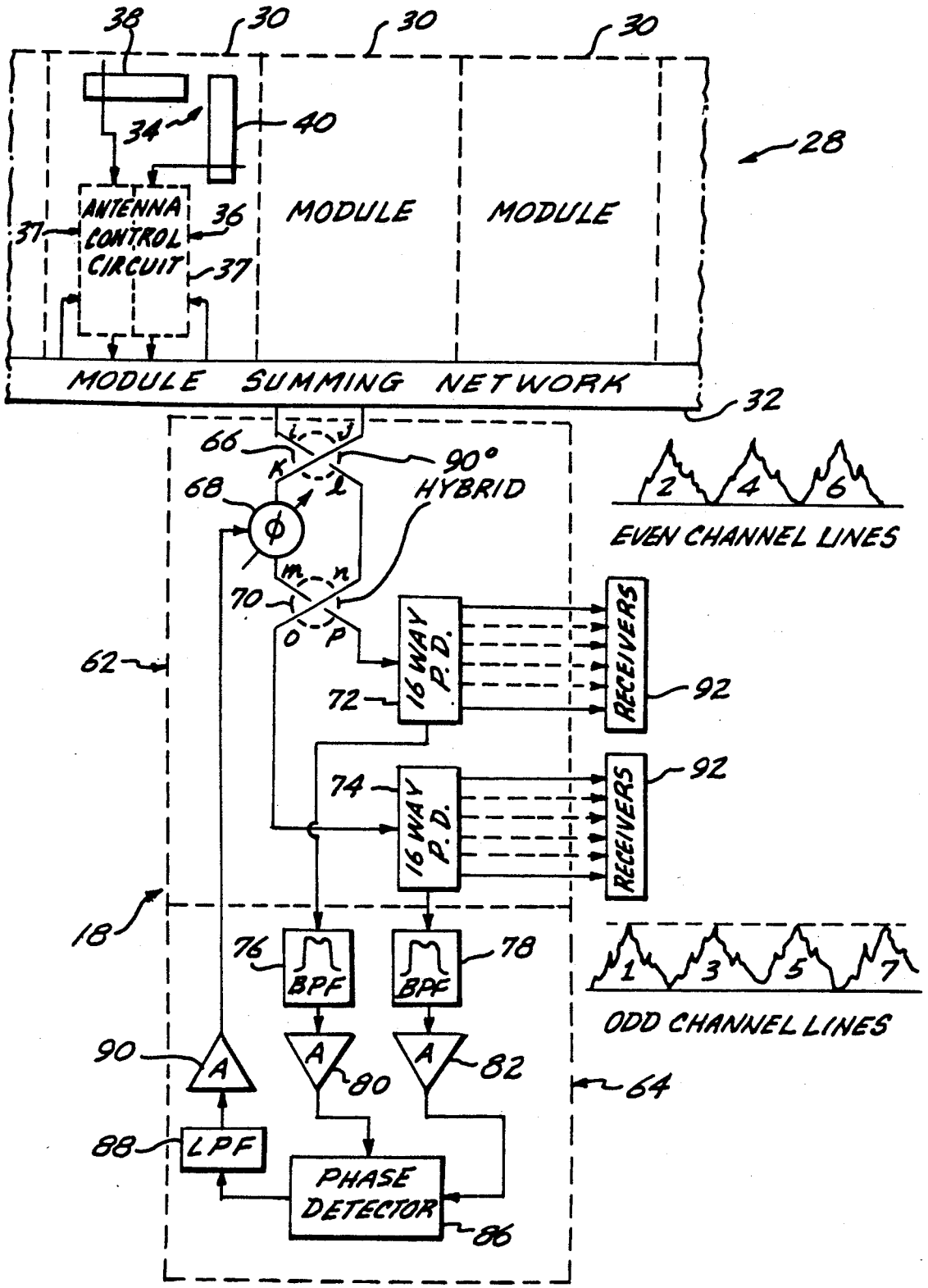
FIG. 3 is a more detailed block diagram of the system employed in FIG. 1, illustrating the components of an antenna control network and polarization tracking network.

As shown in FIG. 3, the controllable antenna network 16 includes an array 28 of antenna modules 30 coupled by a module-summing network 32. Each module 30 includes an orthogonal antenna pair 34, which define an antenna beam that is steerable by an antenna control circuit 36 to receive the frequency reuse communications broadcast by satellite 12. The array 28 conforms to the exterior of aircraft 14 and includes no moving parts. Rather, steering is accomplished electronically as described in greater detail below. In the currently proposed arrangement, 2000 modules 30 are employed to produce an array 28 having a diameter on the order of three feet. The effective aperture defined by array 28, however, is reduced by the steering requirement.

Each antenna pair 34 of a given module 30 includes two orthogonally aligned elements 38 and 40. In the preferred arrangement, these elements are crossed-slot antennas exhibiting an incident radiation passband that limits the coupling of traditionally high-power, low-frequency electromagnetic radiation to the antenna. If desired to further restrict the antennas' response to such signals, the array 28 can be covered with a spatial filter commonly called a frequency-selective surface.

Turning now to a discussion of the details of the antenna control circuit 36 included in each module 30, this circuit has several important functions. First, it provides open-loop control of the antenna pair 34 to steer the antenna beam toward satellite 12 as changes in the relative position of satellite 12 and aircraft 14 are sensed by the gyrosystem 20, altimeter 22, and global positioning system 24. Second, circuit 36 ensures that the signal-to-noise ratio of signals output by the array 28 is not adversely affected by changes in the position of aircraft 14 with respect to satellite 12. Third, circuit 36 may further protect "downstream" electronics from high-power sources of electromagnetic radiation.

To accomplish these functions, the antenna control network 36 includes two series 37 of identical components that separately process communications received by each element 38 and 40 of pair 34. As shown in the representative series 37 of FIG. 4, each series 37 of components includes an input-coupling element or limiter 42, an amplifier circuit 44, and a phase shifter circuit 46.

Addressing these elements individually, input-coupling element 42 is designed to transfer the signal from antenna element 38 to amplifier circuit 44. Input-coupling element 42 may include diode limiters, which are connected to ground to protect amplifier circuit 44 from unintentional exposure to in-band microwave radiation or static discharge. More particularly, the diode limiters become forward biased when exposed to such radiation or discharges, allowing the limiter to conduct the potentially damaging energy to ground. As a result, some of the energy is dissipated and an even greater portion is reflected back to the antenna where it is reradiated.

From input-coupling element 42, signals received by element 38 are applied to amplifier circuit 44. Circuit 44 provides a suitable level of amplification for the received signal, establishes the system signal-to-noise ratio, and ensures that the signal-to-noise ratio of the received signal is maximized as the antenna beam is steered in angle. These functions are accomplished by a combination of a first 90-degree or quadrature hybrid 50, a pair of low-noise amplifiers (LNAs) 52 and 54, and a second quadrature hybrid 56, shown in FIG. 4.

Figure 5:
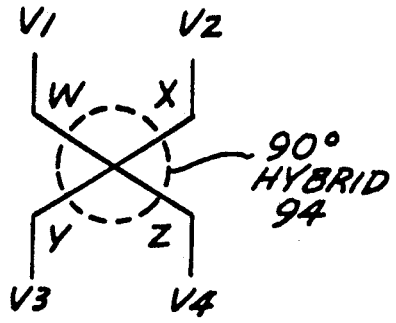
FIG. 5 illustrates a quadrature hybrid of the type included in the antenna control network and polarization tracking network.

Before discussing the operation of the components of amplifier circuit 44 in detail, the functional behavior of a representative quadrature hybrid 94 is first reviewed. As shown in FIG. 5, hybrid 94 has two input ports, w and x, and two output ports, y and z. For purposes of this discussion, it will be assumed that hybrid 94 is ideal, i.e., that it has no insertion loss, amplitude imbalance, phase delay, or phase imbalance.

As shown in FIG. 5, input voltages V1 and V2 are applied to input ports w and x, respectively, of hybrid 94. In the general case, voltages V1 and V2 may have different magnitudes and phases. Hybrid 94 splits the input voltage V1 entering port w into two equal parts that exit hybrid 94 at output ports y and z. The magnitude of each part is equal to the product of 0.707 and the magnitude of V1. The phase of the part exiting port z is delayed by 90 degrees with respect to the phase of the part exiting port y.

Similarly, hybrid 94 splits the input voltage V2 entering port x into two equal parts that exit hybrid 94 at output ports y and z. The magnitude of each part is equal to the product of 0.707 and the magnitude of V2. In this case, however, the phase of the part exiting port y is delayed 90 degrees with respect to the phase of the part exiting port z.

The resultant outputs V3 and V4 at ports y and z of hybrid 94 are composite signals equal to the sum of the two parts applied to each port by hybrid 94. Thus, outputs V3 and V4 depend on the relative magnitudes and phases of input signals V1 and V2. For example, as a first case, if the magnitude of input voltage V1 is zero and the magnitude of input voltage V2 is finite, the outputs V3 and V4 will be of equal magnitude ($0.707 \times V2$) and orthogonal phase, with the phase of V3 delayed by 90 degrees with respect to V4.

As a second case, assume that the input voltages V1 and V2 are equal in frequency and magnitude, but, that the phase of V2 is delayed by 90 degrees with respect to the phase of V1. Given the relative phase of the input voltages, the two component parts of the composite output voltage V4 are in phase with both each other and input signal V2, and the two parts of the composite output voltage V3 are 180 degrees out of phase with each other. Because the input voltages V1 and V2 are equal in magnitude, the two parts of voltage V4 add directly to produce an output V4 whose magnitude is equal to 1.414 (i.e., $0.707+0.707$) times the magnitude of either input signal V1 or V2 and whose phase is the same as input voltage V2. The two component parts of voltage V3, in turn, cancel each other resulting in a null output voltage V3. Thus, when the inputs to ports w and x are orthogonal to each other, equal in magnitude, and of the same frequency, a sum signal will exit only one port y or z. The remaining port will experience a null voltage.

As a third case, assume that input voltages V1 and V2 are of arbitrary relative magnitude but of the same or opposite phase. In this case, the output voltages V3 and V4 will be equal in magnitude but their phase relationship will depend on the ratio of the magnitudes of the two input signals V1 and V2. For example, if the magnitude ratio V1/V2 is equal to one (i.e., $|V1| = |V2|$), the relative phase of output voltages V3 and V4 will be 0 degrees if V1 and V2 are in phase and will be 180 degrees if V1 and V2 are out of phase.

Returning now to a discussion of the components of amplifier circuit 44, quadrature hybrid 50 includes input ports a and b and output ports c and d. Input port a is coupled to a desired resistive impedance, while input port b is coupled to the input-coupling element 42 and receives the signal from antenna element 38. The LNAs 52 and 54 are coupled to output ports c and d, respectively. As described above for the first case in which one input voltage is zero, with no signal applied to port a, the input signal from antenna element 38 is divided equally between the output ports c and d and the hybrid 50 produces a 90-degree phase delay in the signal appearing at output port c.

The second quadrature hybrid 56 includes an input port e coupled to the output of LNA 52, an input port f coupled to the output of LNA 54, and two output ports g and h. As will be appreciated from the discussion of hybrid 50 above, the signals present at terminals e and f are in phase-quadrature (i.e., 90 degrees out of phase). The behavior of these signals through hybrid 56 is as described above for the second case, in which the input signals are of equal magnitude and quadrature phase. As a result, the output at port g equals 1.414 times either input and the output at port h is a signal null. An amplifier 58 connects output port g and the phase shifter circuit 46, while output port h of hybrid 56 is coupled to a resistive impedance to absorb any residual signals that may be present given the nonideal operation of hybrids 50 and 56 and LNAs 52 and 54. In addition, the impedance termination at port h receives and dissipates one-half of the random noise generated within LNAs 52 and 54.

Reviewing further the function of these elements of amplifier circuit 44, the LNAs 52 and 54 amplify the divided signal from antenna element 38, which along with amplifier 58 provides sufficient gain to overcome the noise introduced by subsequent stages of the circuit, including phase shifter 46, summing network 32, and polarization tracking network 18. Thus, although the LNAs 52 and 54 introduce a relatively small level of noise into the system, they establish the system signal-to-noise ratio. To illustrate the system benefits of using two LNAs, rather than one, to provide the low noise amplification, the following discussion is provided.

As a starting point, the total receiver system noise can be defined as the sum of the noise introduced by the antenna 38, hybrid 50, limiter 42, and LNAs 52 and 54, as well as a relatively minimal amount of noise contributed by subsequent signal amplifiers and processing stages including amplifier 58 and phase shifter 46. To accurately interpret received information, the signal-to-noise ratio of the system should remain at the designed level and not change during operation of the system. To limit such changes, the relatively complex arrangement of amplifier circuit 44 is designed to prevent the gain of LNAs 52 and 54 from changing, as might occur if either LNA 52 or 54 was connected directly to the antenna 38.

In that regard, when the antenna array 28 receives signals from different directions, the impedance presented to the amplifier circuit 44 changes. Normally, any change in the input source impedance for LNA 52 or 54 will cause the gain of the LNA 52 or 54 to change. If the gain of LNA 52 or 54 is reduced, the noise contributions of subsequent stages will assume increased importance, reducing the overall signal-to-noise ratio. This problem can be counteracted by designing more gain into each of the LNAs or by isolating the LNAs from the antenna impedance changes in some way.

Figure 4:
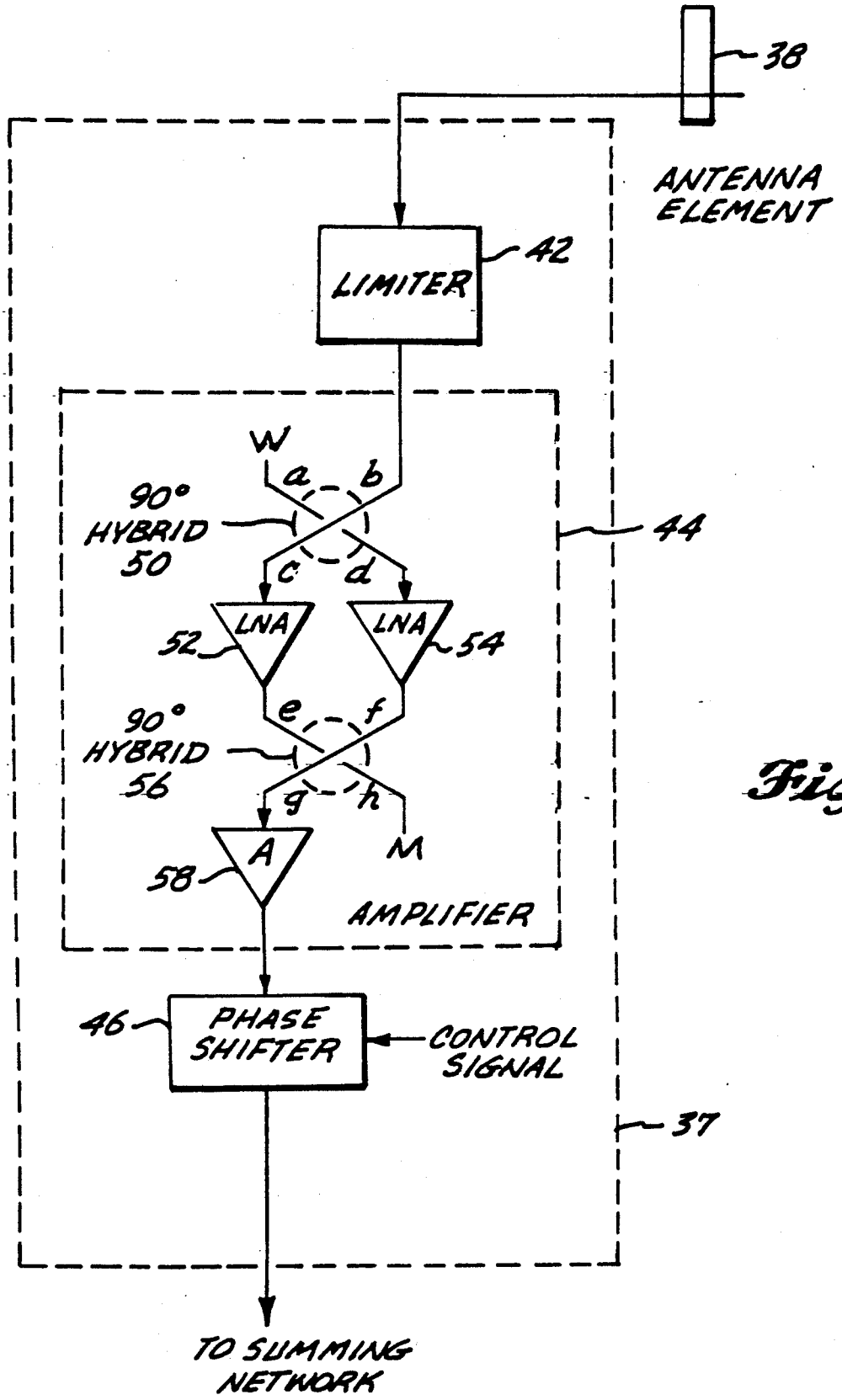
FIG. 4 is a block diagram of a typical phased array antenna element and the portion of the antenna control network that governs its operation.

In the preferred embodiment illustrated in FIG. 4, this deterioration of the signal-to-noise ratio is limited by using quadrature hybrid 50 to isolate LNAs 52 and 54 from impedance changes of antenna 38. As understood by one of ordinary skill in the art of RF circuit design, by employing quadrature hybrid 50, reflected energy from each LNA input is split two ways, thereby providing the LNAs 52 and 54 with a minimum of 6 dB of isolation from the impedance of antenna 38. As a result, changes in the antenna's impedance occurring when the antenna beam is steered to correct for changes in the relative orientation of aircraft 14 and satellite 12 will not significantly affect the overall signal-to-noise ratio. In analyses conducted to compare the gain stability of the hybrid-coupled, balanced LNA configuration of amplifier circuit 44 with the gain stability of a single-ended LNA arrangement when exposed to a three-to-one source impedance mismatch, the balanced LNA gain changed less than one dB, while the single-ended LNA gain changed by more than four dB. Thus, the signal-to-noise ratio is substantially maximized.

Figure 6:
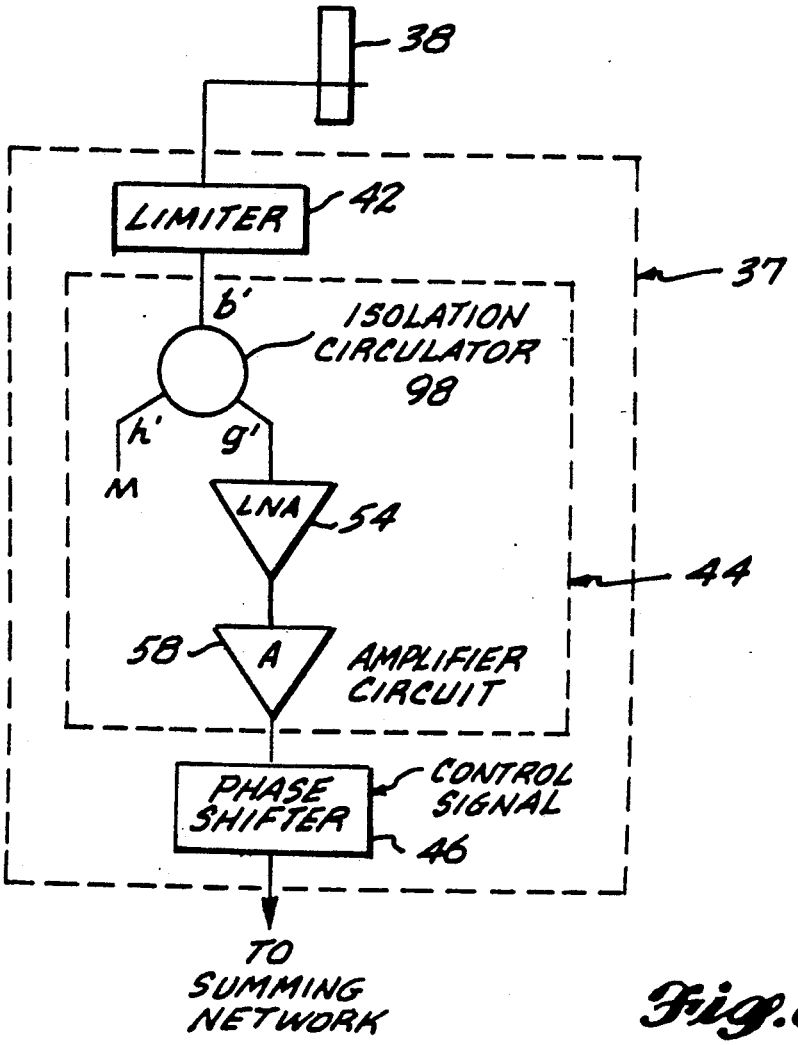
FIG. 6 is a block diagram of an alternative embodiment of a phased array antenna element and the portion of the antenna control network that governs its operation, including an isolator for impedance matching.

FIG. 6 is a block diagram of the phased array antenna element of FIG. 4, with an alternative series of components employed in control network 36. In this embodiment, the limiter 42 is connected to input terminal b′ of a ferrite isolator/circulator 98. Output terminal h′ of isolator/circulator 98 is connected to a resistive impedance and output terminal g′ of isolator/circulator 98 is connected to the input of LNA 54. Use of the well-known isolator/circulator element 98 can typically provide 20 dB isolation per isolator between the antenna 38 and the LNA 54. In this embodiment, no hybrids and only one LNA are required. The ferrite isolator/circulator 98 does, however, include a somewhat heavy permanent magnet, the consequences of which may offset the weight savings resulting from removal of the hybrids and one LNA.

Addressing now the phase shifter circuit 46 of module 30, as will be appreciated, it can be designed to provide digital or analog control of phase. In the preferred arrangement, circuit 46 is of a four-bit digital design, with the four bits providing 180-, 90-, 45-, and 22.5-degree phase shifts. As will be appreciated, by selecting various combinations of these bits, a relatively wide range of phase shifts (all increments of 22.5 degrees) can be easily effected.

The beam of the antenna pair 34 is steered electronically by the two phase shifter circuits 46. More particularly, by controlling the phase of the signals received relative to other adjacent modules 30 in the array 28, the response of each element 38 and 40 to radiation impinging upon the pair 34 from a given direction is constructively summed with all other module 30 outputs. Thus, the relative contribution of the two antenna elements 38 and 40 can be adjusted as desired, effectively steering the antenna beam of the array 28 of antenna element pair 34.

Open-loop control of phase shifters 46 is provided by the computer 26 on aircraft 14. As noted previously, computer 26 continuously monitors information from gyrosystem 20, altimeter 22, and global positioning system 24 and determines the relative position and orientation between satellite 12 and aircraft 14 pursuant to software instructions programmed into computer 26. With relative position and orientation known, computer 26 can then further compute the relative alignment between antenna elements 38 and 40 and the desired antenna beam. Finally, computer 26 generates the control signal that is applied to the phase shifter circuits 46 to effect the desired steering control. This method is used to "acquire" the satellite signal and, depending on the precision available from such open-loop control, may be employed to "track" the signal, also. A closed-loop tracking system, however, might make an economical addition and would likely involve continuous conical scanning of the beam to maintain tracking.

In the preferred arrangement, the electronics portion of each module 30 is realized with the use of monolithic microwave-integrated circuits provided on gallium arsenide or another appropriate semiconductor. The antenna control circuits 36 on the various modules 30 may be integrated onto a single chip or they may be produced individually and interconnected. As will be appreciated, the preceding discussion of the processing of the signal from antenna element 38 applies equally to the processing of signals from element 40 and is the same for each of the modules 30 in array 28.

Having described the manner in which module 30 receives frequency reuse communications from satellite 12, the combination of these signals and their further processing by network 18 will now be discussed. The module-summing network 32, shown in FIG. 3, combines the outputs from each element in array 28 having the same polarity. Thus, the signals received by each element 38 in array 28 are combined at summing network 32, as are the signals received by each element 40. This is accomplished most simply by use of a passive hollow waveguide or printed stripline circuit for network 32. In addition, the summing network includes a down converter for reducing the frequency of the satellite communications to a more convenient level.

As will be appreciated from the preceding remarks, the summing network 32 produces two outputs corresponding to signals received by the orthogonally polarized aircraft antenna elements 38 and 40 in each module 30. As a practical matter, since the satellite signal polarizations and the aircraft antenna polarizations are rarely in alignment, both outputs of network 32 may contain signals from channels of both polarities. To reduce this "cross-polarization," the polarization tracking network 18 is included in the system. As shown in FIG. 3, the polarization tracking network 18 can be broken into a forward section 62 and a feedback section 64. Together, the sections 62 and 64 provide closed-loop control of signal polarity.

Reviewing the forward section 62 first, as shown in FIG. 3, it includes a first quadrature hybrid 66, adjustable phase shifter 68, second quadrature hybrid 70, and two power dividers 72 and 74. Hybrid 66 includes input ports i and j and output ports k and l. In the arrangement depicted, the signals received by antenna elements 38 are applied to input port i, while the signals received by antenna elements 40 are input to port j. Thus, if proper polarization of the signals transmitted between satellite 12 and aircraft 14 is not maintained, input signals at i and j will each contain both even and odd channel signals. Furthermore, the even channel components of input signals i and j will be either in phase or out of phase, as will be the odd channel components of input signals i and j. It should be noted that the antenna array 28 would only rarely be oriented such that only vertically polarized signals are received by antenna element 38 and only horizontally polarized signals are received by antenna element 40. Generally, each element 38 and 40 receives some signals of both polarizations.

As will be appreciated, the hybrid 66 applies equal amounts of each input signal to the two output ports k and l, with a 90-degree phase shift being applied to one of the component signals as discussed above in reference to FIG. 5. Output port k is coupled by the adjustable phase shifter 68 to an input port m of hybrid 70, while output port l of hybrid 66 is directly coupled to an input port n of hybrid 70. Hybrid 70, like hybrid 66, divides signals applied to its two input ports evenly between the output ports and applies a similar 90-degree phase shift to one of the components.

With phase shifter 68 set properly in the manner described below, the signal passed by output port p of hybrid 70 will include only the properly polarized even channel information. This information is then applied to the power divider 72, which divides it between 16 output terminals. Similarly, the output of port o will include only the properly polarized odd channel information, which is then applied to power divider 74 and divided between 16 output terminals.

Addressing now the details of the feedback section 64 of network 18 and the manner in which phase shifter 68 is controlled, reference is again had to FIG. 3. In accordance with this invention, the feedback section 64 monitors a single channel of the communication information to correct polarization for all channels. This channel is preferably selected from the middle of the frequency band to provide the best correction for all channels.

To monitor the single channel, a pair of bandpass filters 76 and 78 further process the signals from power dividers 72 and 74, respectively. Assuming, for example, that channel 16 of a 32-channel system is selected for use in polarization tracking, this channel should be present only in the output of the "even" power divider 72, once closed-loop control is provided. Channel 16 will be present at the output of power divider 74, however, in the event that the desired closed-loop polarization has not been achieved, for example, due to a momentary change in aircraft attitude relative to the broadcast satellite.

The outputs of filters 76 and 78 are amplified by amplifiers 80 and 82 to provide the gain necessary for further processing. The two signals are then compared at a phase detector 86. The phase detector 86 effectively compares the phase of channel 16 present at the output of divider 72 with the phase of the undesired portion of channel 16 present at the output of divider 74, in the following manner.

As noted above, components of channel 16 will appear at both input ports i and j when the desired polarization alignment is not achieved. These components will be either in phase or 180 degrees out of phase. In either case, as described earlier in connection with FIG. 5, the output ports k and l will contain equal amplitude components of channel 16 but the relative phase of these components will depend on the relative magnitudes of the channel 16 components at input ports i and j. The function of phase shifter 68 is to adjust the phase of the output signal at port k until the signal at port m is orthogonal in phase to the output signal applied to port n. As a result, the signals applied to ports m and n will be equal in magnitude but orthogonal in phase. With such signals applied to ports m and n, all of the energy in channel 16 will be present at the output port p and no component of channel 16 will be present at output port o, as previously discussed in connection with FIG. 5.

The adjustment of phase shifter 68 is determined by the relative phase of the components of channel 16 at output ports o and p (or alternatively, at the input ports of phase detector 86). Where these component signals approach an in-phase condition, phase shifter 68 is driven in one direction, for example, advancing the phase. If the component signals approach an out-of-phase condition, phase shifter 68 is driven in the opposite direction, for example, delaying the phase. As a result of these adjustments, the channel 16 component output by power divider 74 is driven to a null and any small residual component output by divider 74 will be orthogonal to the signal output by divider 72, so no error signal is present to further adjust phase shifter 68.

As will be appreciated from the preceding remarks, the output of phase detector 86, which is filtered by a low-pass filter 88 and amplified by amplifier 90, is used to effect closed-loop control of the adjustable phase shifter 68. The phase detector 86 has a null at its output when either there is no input present at either input port or when orthogonal signals are applied to the two input ports. When orthogonality is not maintained, the magnitude of the output of phase detector 86 is proportional to the magnitudes of the two inputs and to the angular deviation of their relative phases from orthogonality. When the output of phase detector 86 is zero, indicating that the desired polarity has been achieved, the phase shifter 68 undergoes no adjustment and polarization is maintained. On the other hand, when the signals are not properly polarized, phase detector 86 produces an output that causes an increase/decrease in the delay produced by phase shifter 68.

The final components of the system of FIG. 3 to be discussed are a plurality of receivers 92, one for each channel that is to be received. The receivers 92 are coupled to the power dividers 72 and 74 and receive the polarized signals therefrom. More particularly, the receivers 92 (up to 16 per polarization) coupled to divider 72 are tuned to the even channels, while the receivers 92 coupled to divider 74 are tuned to the odd channels. Although not illustrated in the FIGURES, it will be appreciated that the signals from the various receivers 92 are then distributed throughout the aircraft 14 for use by the passengers and crew.

Reviewing the operation of the preceding system, as will be appreciated, communications from satellite 12 can be continuously received by the aircraft 14 both on the ground and in the air. When the aircraft 14 is in flight and its relative position and orientation with respect to satellite 12 change, the computer 26 monitors the change and provides a signal to the phase shifter circuits 46 associated with each antenna module 30. This allows the beam of the array 28 to be maintained in alignment with the satellite 12, regardless of the aircraft's attitude. Although this approach is accomplished open-loop without feedback from the array 28, as will be appreciated, it could be accomplished, as necessary, with greater complexity by incorporating closed-loop feedback.

Like the controllable antenna network 16, the polarization tracking network 18 adjusts to the changing relationship between satellite 12 and aircraft 14 as that relationship affects the polarization of the signals produced at power dividers 72 and 74. More particularly, as the select channel passed by filters 76 and 78 increasingly or decreasingly appears on the undesired polarity, the phase detector 86 responds accordingly to control the phase shifter 68 and bring the outputs of power dividers 72 and 74 back into the desired polarity. Thus, the disclosed system maintains the desired antenna tracking, signal-to-noise ratio, and polarization of the output signals independent of changes in the relationship between satellite 12 and aircraft 14.

Those skilled in the art will recognize that the embodiments of the invention disclosed herein are exemplary in nature and that various changes can be made therein without departing from the scope and the spirit of the invention. In this regard, the disclosed invention is described in connection with a preferred application involving communications between a geostationary satellite and moving aircraft. As will be appreciated, however, the invention can be employed in any system in which polarization may be varied or antenna position corrected. Because of the above and numerous other variations and modifications that will occur to those skilled in the art, the following claims should not be limited to the embodiments illustrated and discussed herein.

The embodiments of the invention in which an exclusive property or privilege is claimed are defined as follows:

1. A movable system for receiving staggered frequency reuse communications from a referentially fixed source, said system comprising:

a controllable antenna for receiving said frequency reuse communications from the source; and adaptive polarization tracking means for maintaining a desired polarization of the communications received by said antenna.

2. The system of claim 1, wherein the frequency reuse communications comprise orthogonal, linearly polarized signals.

3. The system of claim 2, wherein the source comprises a geostationary satellite.

4. The system of claim 3, wherein said system further comprises an aircraft and a positional sensing system, for determining the position of said aircraft with respect to the satellite, said antenna, adaptive polarization tracking means, and positional sensing system being coupled to said aircraft.

5. The system of claim 2, wherein said antenna comprises a steerable phased array of orthogonal element pairs.

6. The system of claim 5, further comprising antenna control means for steering said array to receive the polarized signal.

7. The system of claim 6, wherein said antenna control means comprises a pair of phase shifters coupled to each of said orthogonal element pairs.

8. The system of claim 7, wherein said antenna control means further comprises low-noise amplifiers for coupling each pair of phase shifters to each orthogonal element pair.

9. The system of claim 2, wherein said polarized signals define a plurality of first and second channels.

10. The system of claim 9, further comprising a summing network for separately summing the polarized signals received by said antenna.

11. The system of claim 10, wherein said adaptive tracking means comprises selection means for selectively monitoring the summed polarized signals to determine whether one of said plurality of first channels is included in both said orthogonal, linearly polarized signals.

12. The system of claim 11, wherein said adaptive tracking means further comprises phase detection means for comparing the phase of one of the summed polarized signals with the phase of the other of the summed polarized signals.

13. The system of claim 12, wherein said adaptive tracking means further comprises a pair of cross-coupled quadrature hybrids connected by controllable phase shift means, said pair of hybrids coupling said summing network and said selection means, said controllable phase shift means being responsive to said phase detection means to null said one of said plurality of first channels transmitted by one of said polarized signals.

14. The system of claim 9, further comprising a plurality of receivers for receiving said first and second channels.

15. An adaptive polarization tracking network for maintaining a desired polarity between a first polarized signal defining a first set of information channels and a second polarized signal defining a second set of information channels, said network comprising:

monitor means for monitoring the first and second polarized signals and producing an output indicative of the presence of a select information channel on each; and null means, responsive to said output of said monitor means, for nulling the select information channel on one of the first and second polarized signals to maintain the desired polarity therebetween.

16. The network of claim 15, wherein said monitor means comprises:

filter means for filtering the first and second polarized signals to pass the select information channel present on each; and phase detection means for detecting the difference between the phase of the select information channel present on the first and second polarized signals after being passed by said filter means, said phase detection means producing said output indicative of the presence of a select information channel on said first and second polarized signals.

17. The network of claim 16, wherein said null means comprises:

first hybrid means, including first and second input ports and first and second output ports, the first polarized signal being applied to said first input port and the second polarized signal being applied to said second input port, said first hybrid means being for dividing said first polarized signal equally between said first and second output ports and producing a phase shift at one of said first and second output ports and for dividing said second polarized signal equally between said first and second output ports and producing a phase shift at one of said first and second output ports to provide a first combined signal at said first output port and a second combined signal at said second output port;

controllable phase shift means coupled to said first output port of said first hybrid, for controllably shifting the phase of said first combined signal; and second hybrid means, including a first input port coupled to said controllable phase shift means, a second input port coupled to said second output port of said first hybrid means, a first output port, and a second output port, said second hybrid means being for dividing said first combined signal equally between said first and second output ports of said second hybrid means and said second combined signal equally between said first and second output ports of said second hybrid means.

18. The network of claim 17, wherein said filter means comprises a pair of bandpass filters.

19. The network of claim 17, wherein said select information channel is a member of the first set of information channels and is not present on the second polarized signal when the desired polarity is maintained.

20. The network of claim 15, wherein said network is coupled to an aircraft and is for maintaining the desired polarity as said aircraft moves with respect to a referentially fixed source of the polarized signals.

21. A steerable antenna system comprising:

a steerable antenna for receiving electromagnetic radiation and producing a signal in response thereto; and means for maintaining a substantially maximized signal-to-noise ratio for said signal as said antenna is steered, including:

a first quadrature hybrid, having a first input port and first and second output ports, said antenna being coupled to said first input port, said first hybrid being for dividing said signal produced by said antenna equally between said first and second output ports;

a pair of low-noise amplifiers, coupled to said first and second output ports, for amplifying said signal divided between said first and second output ports; and a second quadrature hybrid, having first and second input ports, coupled to said pair of low-noise amplifiers, and a first output port, said second quadrature hybrid being for summing said signal divided by said first hybrid and amplified by said amplifiers to produce a system output.

22. The system of claim 21, further comprising phase shift means for shifting the phase of said output.

23. A method of receiving frequency reuse communications at a site that is relatively movable with respect to a source of the communications, comprising:

steering an antenna system to maintain an antenna beam directed toward said source as the site and source undergo relative motion and receive the frequency reuse communications; and adaptively correcting the polarization of the frequency reuse communications received by the antenna system to maintain a desired polarization as the site and source undergo relative motion.

24. A method of maintaining a desired polarity between first and second sets of channels received from a frequency reuse communication source, comprising the steps of:

monitoring the first set of channels for the presence of a select channel that is present in the first set unless the desired polarity is achieved; and nulling the select channel present in the first set of channels when its presence is monitored.

25. A method of receiving frequency reuse communications at a site that is relatively movable with respect to a source of the communications, comprising:

steering an antenna system to maintain an antenna beam directed toward said source as the site and source undergo relative motion and receive the frequency reuse communications; and processing the frequency reuse communications received by the antenna system to maintain a substantially maximized signal-to-noise ratio as the site and source undergo relative motion.

* * * * *